United States Patent [19]

Bozek

[11] Patent Number: 4,917,071

[45] Date of Patent: Apr. 17, 1990

[54] MECHANICAL PROJECTOR WITH VARIABLE LEVERAGE DEVICE

[76] Inventor: John W. Bozek, 6093 Waterford Dr., Waterford, Mich. 48095

[21] Appl. No.: 279,293

[22] Filed: Nov. 30, 1988

Related U.S. Application Data

[63] Continuation of Ser. No. 26,278, Mar. 16, 1987, abandoned, which is a continuation-in-part of Ser. No. 778,405, Sep. 20, 1985, Pat. No. 4,649,891.

[51] Int. Cl.[4] ..... F41B 5/00

[52] U.S. Cl. ..... 124/25; 124/24 R

[58] Field of Search ..... 124/24, 25

[56] References Cited

U.S. PATENT DOCUMENTS

| | | | |
|---|---|---|---|
| 269,249 | 12/1882 | Wilcox | 124/25 |
| 1,328,967 | 1/1920 | Reaben | 124/25 |
| 1,375,990 | 4/1921 | Yorgensen | 124/25 |
| 2,842,114 | 7/1958 | Duncan | 124/35 R |
| 3,028,851 | 4/1962 | Drake | 124/25 |
| 3,809,048 | 5/1974 | Handford | 124/25 |
| 4,169,456 | 10/1979 | Van House | 124/25 |
| 4,438,753 | 3/1984 | Simonds | 124/24 R |

*Primary Examiner*—Edward M. Coven

*Assistant Examiner*—Gary Jackson

*Attorney, Agent, or Firm*—John R. Benefiel

[57] ABSTRACT

An improved mechanical projector is disclosed of the type including a stock member and a drawstring extending across the stock member to engage a projectile lying along the stock member axis. Variable leverage devices are mounted in various ways on either side of the stock member, drivingly interconnecting the drawstring and at least on resiliently deflectable member such as a pair of prod limbs or a pair of elastic elements. Each variable leverage device includes a rotary element connected to a drawstring segment and causing flexing of an associated deflectable member by drawing of the drawstring with increasing leverage with advancing draw movement. The rotation of the rotary element in each variable leverage is synchronized by a constraint imposed by a driving connection to a slider element movable along the length of the stock member. In the disclosed embodiments, the driving connection is provided by affixing the drawstring to the slide and alternatively to load cables also attached to the rotary elements causing deflection of the deflectable members by drawing of the drawstring.

9 Claims, 6 Drawing Sheets

MECHANICAL PROJECTOR WITH VARIABLE LEVERAGE DEVICE

CROSS REFERENCE TO RELATED APPLICATIONS

This application is a continuation of application Ser. No. 026,278, filed 3-16-87, now abandoned, which is continuation-in-part of Ser. No. 778,405, filed 9-20-85, now U.S. Pat. No. 4,649,891.

BACKGROUND OF THE INVENTION

This invention concerns mechanical projectors such as cross bows in which a drawstring is mounted across a stock member and is drawn rearwardly to act on variable leverage devices which in turn cause deflection of one or more resiliently deflectable members which are released at firing to accelerate and launch a projectile.

BACKGROUND DISCUSSION

In mechanical projector devices such as bows and cross bows, each limb of a bow member, (called a "prod" in cross bows) bends or flexes as the connecting drawstring is drawn and the stored potential energy is converted into kinetic energy of the projectile, i.e., the arrow, (referred to as a "bolt" in cross bows) as the drawstring and limbs move to the restored condition after release. Instead of a prod, elastic elements have sometimes been used in mechanical projectors which are stretched to generate stored energy.

It has heretofore been recognized that uncoordinated bending of the limbs can result in a less accurately controllable arrow flight.

The problem of uncoordinated limb flexing is most pronounced in the context of mechanical projectors utilizing variable leverage devices which allow a draw force drop off as the moves to the fully drawn position in order to facilitate a steady aim and better acceleration characteristics at release. Unsynchronized rotation of the rotary elements of those devices will result in uncoordinated, unequal bending of the connected limbs.

A compound bow using variable leverage devices is described in the Allen U.S. Pat. No. 3,486,495. In such a construction, there is provided a pair of crossing load cables, which by a cross leverage effect, insures coordinated limb tip bending.

The presence of the crossing load cables is aesthetically unpleasing and also tends to create an interfering obsctacle for the arrow in the space between the drawstring and the bow member.

Other arrangements for insuring coordinated limb flexing have included a "figure eight" cable pattern passing around synchronizing wheels located adjacent the central grip.

It would be advantageous to eliminate such load cables froom the space through which the arrow or bolt passes and also to eliminate the centrally disposed synchronizing mechanisms in the interest of simplicity.

Accordingly, it is an object of the present invention to provide an improved mechanical projector such as a variable leverage device in which coordinated flexing of the limbs or stretching of elastic elements is insured by a synchronization of the rotary elements without the need for the addition of extensive auxiliary synchronizing structure.

SUMMARY OF THE INVENTION

These and other objects of the present invention which will become apparent upon a reading of the following specification and claims are achieved by a constraint exerted by a slide moving along the length of a stock member. An interconnection is provided between the rotary elements of the variable leverage devices and the slide, synchronizing the rotation of the respective rotary elements. This interconnection in the disclosed embodiments is a connection of the drawstring to the slide, constraining the side-to-side movement of the mid or nocking point of the drawstring as it is released and travels to the restored position to insure synchronized rotation of the rotary elements. Flexing of the respective prod limb tips or elastic elements is thereby necessarily coordinated and equal.

The slider element is disposed within the lengthwise track extending along the stock member to be mounted thereto.

In a cross blow comprising one embodiment of the present invention, drawstring segments pass around pulleys mounted at either prod limb tip and are each connected to one of a pair of rotary elements of a variable leverage device, each mounted at the forward end of one side of the stock member on a bracket affixed thereto. A load cable extends between each of the variable leverage rotary elements and to a respective prod tip such that load cables do not pass across the stock member, to lie in the path of the projective.

In another embodiment the pulleys are eliminated and the drawstring segments are wrapped about the periphery of rotatably mounted curved arms each comprising a variable leverage device to which are also attached load cables extending to the prod limb tips. The curved arm rotary elements are mounted on brackets located on either side of the forward end of the stock member in this embodiment, thus eliminating the need for pulley elements at the prod limb tips.

In another variation, the variable leverage rotary elements are mounted to the stock member by spaced anchoring cable pairs connected at points aligned with the axis of rotation of the rotary element and to the side of the stock member. Corresponding pairs of load cables extend from the respective prod limb tip the respective rotary element. The associated drawstring segment is wrapped about the periphery of the respective curved arm. The use of cable pairs eliminates the need for rigid bracketry on the stock member by applying balanced forces to the rotary element.

In yet another embodiment, the variable leverage devices comprise swing out mounted lever arm pairs, each comprised of levers pinned together at one end, and the other end of one of the arms in each pair pivotally mounted on either side of the stock. A pair of load cables extend between the prod tip and an intermediate point on the one lever arm in each pair. The respective drawstring segments are attached to the other end of the free lever arm, which also has attached thereto a reaction cable fastened to the stock member.

The swing out mounting of the lever arm pairs enables extensive draw distance with minimal prod limb tip deflection, such that a short, rigid prod may be employed while still providing a substantial drawstring draw distance.

In another embodiment of the invention, a pair of elastic elements is utilized to generate stored energy by drawing of the drawstring which is stretched by rotation of the rotary elements.

In another variation, load cables are connected to the slide to synchronize the rotary elements, the slide inturn connected to a single elastic element.

Finally, in another version, rotary elements comprising variable leverage devices are connected to the stock, with the drawstring connected to the rotary element, directly, load cables are pulled by the rotary elements to move a slide connected to the ends of a secondary drawstring connected to the prod limb tips.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
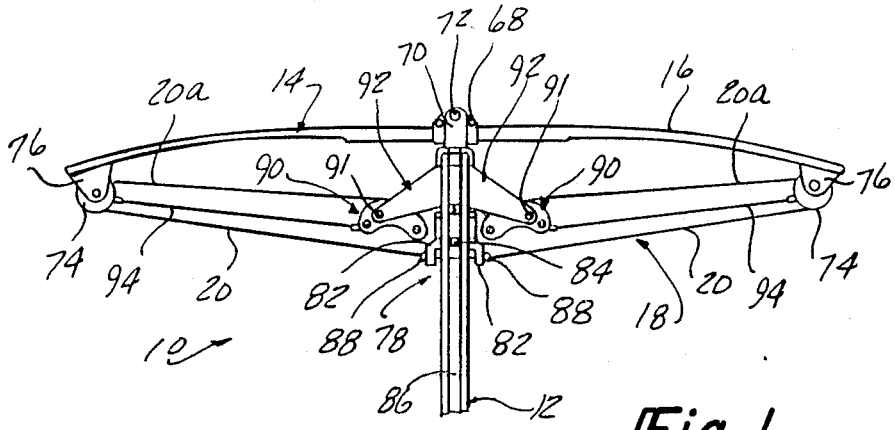
FIG. 1 is a fragmentary plan view of an embodiment of a cross bow incorporating the present invention.
Figure 2:
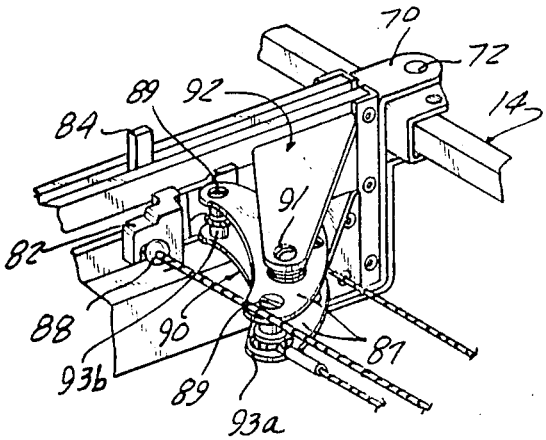
FIG. 2 is a fragmentary perspective view of portions of the cross bow shown in FIG. 1.
Figure 3:
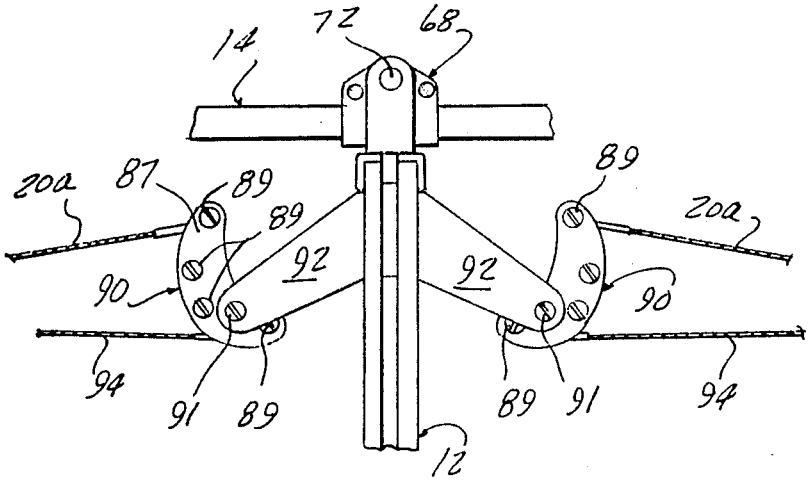
FIG. 3 is a fragmentary plan view of the cross bows shown in FIGS. 1 and 2, depicting the position of the variable leverage devices with the drawstring in a drawn position.
Figure 4:
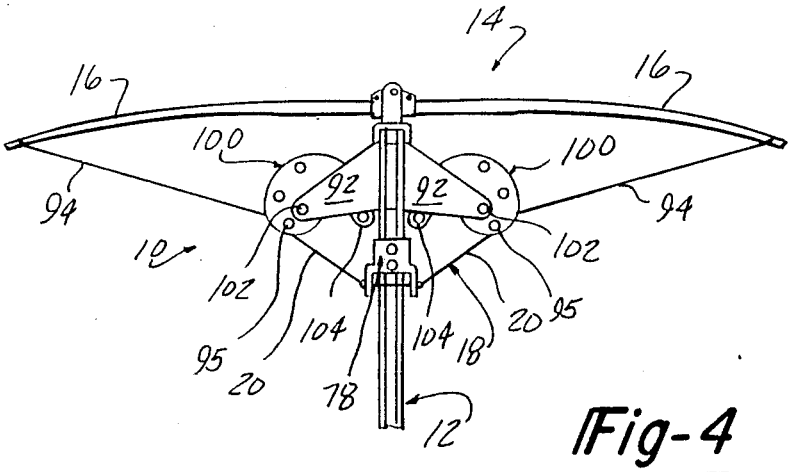
FIG. 4 is a fragmentary plan view of another embodiment of a cross bow incorporating the present invention.
Figure 5:
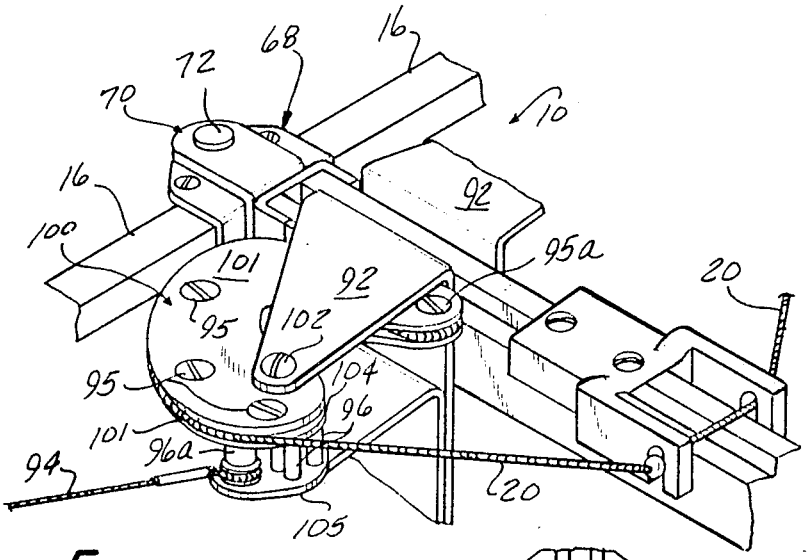
FIG. 5 is a fragmentary perspective view of portions of the cross bow shown in FIG. 8.
Figure 6:
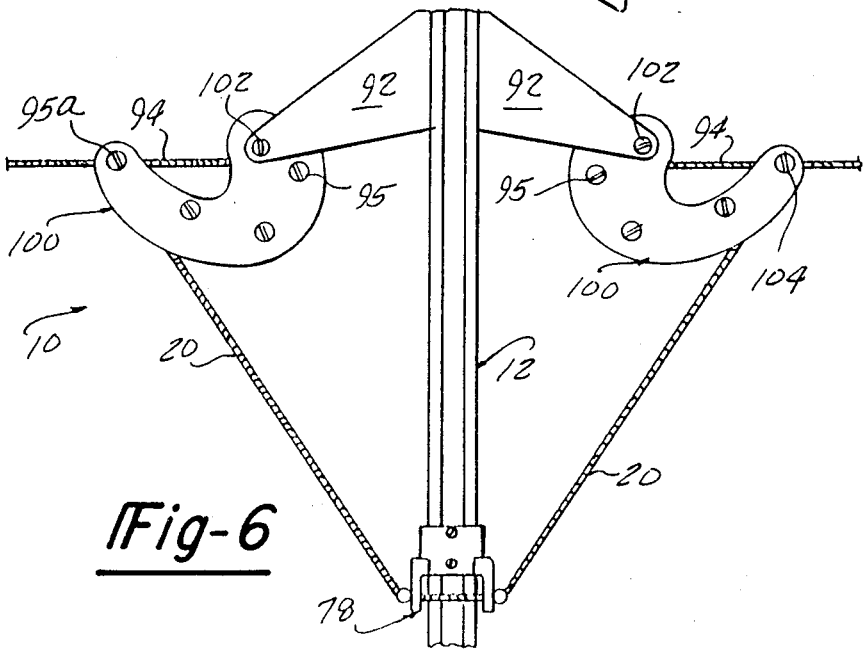
FIG. 6 is a fragmentary plan view of the cross bow shown in FIGS. 4 and 5 illustrating the position of the variable leverage devices with the drawstring in the drawn position.

A cross bow 10 incorporating the concept of the present invention to synchronize variable leverage devices 90 is shown in FIG. 1 through 3. A pair of resiliently deflectable members is provided to generate stored energy, here comprised of the limbs 16 of a prod 14. The prod 14 is advantageously pivotally mounted at its midpoint at the forward end of the stock member 12, as in the above described copending patent application. A bracket 68 is provided attached to the prod midpoint, with the bracket 68 mounted within a clevis 70 by means of a quick release pin 72.

A pair of pulley wheels 74, and clevis brackets 76 are mounted at the tip of each limb 16 of the prod 14.

The drawstring 18 includes segments 20 each extending from a slider 78 having left and right hand portions 80 and 82, and a central bolt engaging protuberance 84 received within track 86, formed lengthwise along the length of the stock member 12, to constrain the slider 78 for lengthwise movement along the stock member 12.

The drawstring 28 is secured side to side by means of stops 88 affixed thereto preventing such lateral movement of the drawstring 18 with respect to the slider 78 and stock member 12. The drawstring segments 20 each pass around the respective pulleys 74, and extend back towards the stock member 12, and are anchored to variable leverage rotary elements 90, each constituting a variable leverage device, pivotally mounted at 91 on either side of the stock member 12 in clevis anchors 92.

Also provided are means for generating stored energy by flexing of the limbs 16 of the prod 14 by drawing of the drawstring 18 and the action of the rotary elements 90. This means includes a pair of respective load cables 94, each secured at one end around a spacer 93 located on the outboard end of a rotary element 90, and at the other end around the axle of the respective pulley 74, as shown in FIG. 1. The rotary elements 90 are comprised of curved arms made up of a pair of spaced curved plate 87, secured together by screws 89 and spacers 93. The point of attachment of the inner drawstring segments **20*a* is around spacer 93*b*, located on the other side of the pivotal mounts 91, such as to create an opposing leverage, created by tension on the drawstring 18 acting to flex the respective limbs 16** when drawn to the rear.

The variable leverage rotary element 90 is comprised of curved arms as indicated, such that as the rotation of the rotary variable leverage elements 90 proceeds with the unwrapping of the drawstring segments 20, the leverage generated by the tension of each drawstring segment 20 acting on the load cables 94 increases as shown in FIG. 3. That is, the effective lever arm length about pivot axis 91 increases as the rotary element 90 is rotated about the pivot point 91 as the drawstring slide 78 is moved to the rear and rotation of the elements 90 occurs, as seen in FIG. 3. This thus affords a variable leverage feature, in that a reduced force is required as the drawstring 18 moves to the fully drawn position.

As will be appreciated by those skilled in the art, the use of the variable leverage devices reduces the stress on the catch mechanism, allows the use of a shorter prod, and results in the more effective acceleration of the bolt. The rotation of the rotary elements 90 is perfectly synchronized by the driving interconnection between these elements 90 and the constrained slider 78 constituted by the drawstring 18, without the necessity of a separate synchronizing mechanism. Thus, the limbs 16 of the prod 14 are equally flexed in prefer coordination.

To eliminate the pulleys 74, and associated hardware, the drawstring 18 may be directly attached to the rotary elements.

Figure 8:
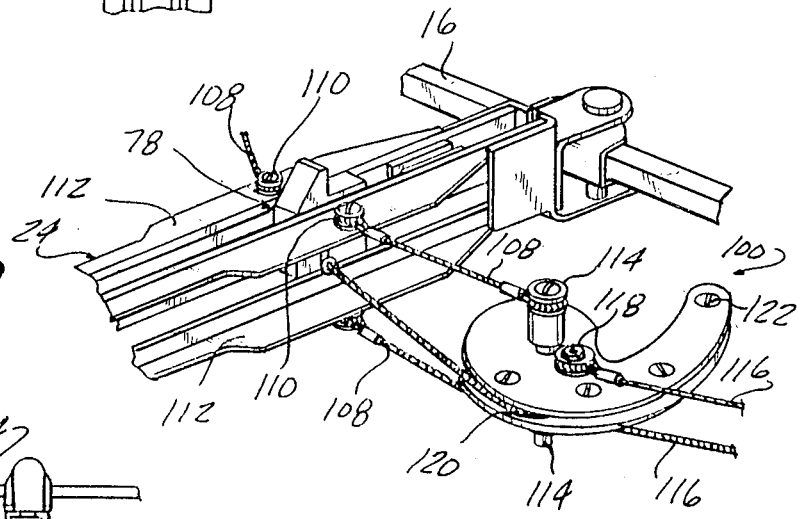
FIG. 8 is a fragmentary perspective view of portions of the cross bow shown in FIG. 7.
Figure 9:
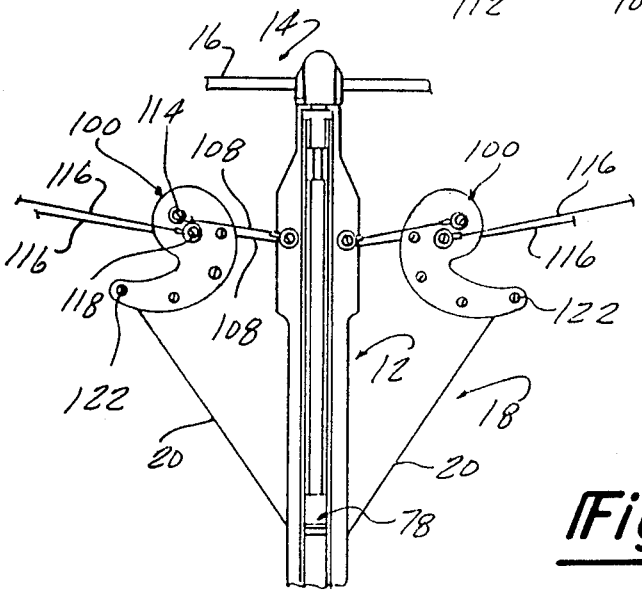
FIG. 9 is a fragmentary plan view of portions of the cross bow shown in FIGS. 7 and 8, illustrating the variable leverage devices with the drawstring in the drawn position.
Figure 10:
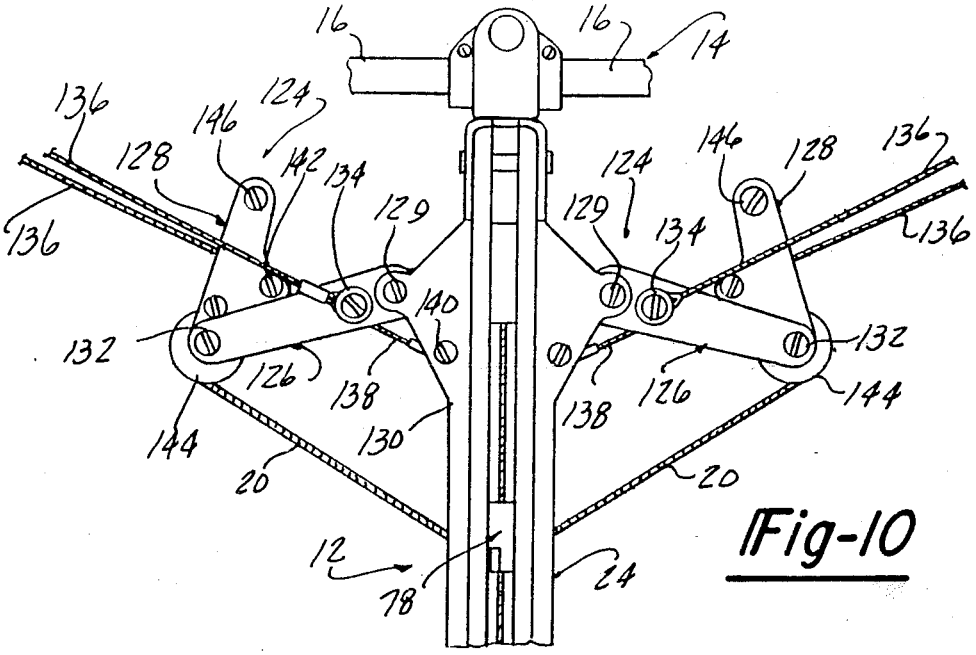
FIG. 10 is a fragmentary plan view of another embodiment of a cross bow incorporating the present invention.

A further embodiment of a mechanical projector according to the present invention is shown in FIGS. 8 through 10, illustrating just such an arrangement. In this instance, relatively large curved arm rotary elements 100 are provided, each comprising the variable leverage devices pivotally mounted at 102 in U-shaped clevis brackets 92 affixed to either side of the stock member 12. Each curved arm rotary element 100 is comprised of curved plates 101 sandwiching a grooved sheave member 104, held together by screws 95. A third plate 105 is mounted thereto offset below by spacers 96, and load cables 94 are attached by being looped around spacer 96.

The drawstring segment 20 wraps around the periphery of the sheave member 104 of curved arm rotary element 100, to a point of attachment to screw 95*a* located at the "tail" portion of the respective rotary element 100, so that the tension exerted by the drawstring segments 200 is in opposition to that exerted by the load cables 94.

Sheave members 104 enable smooth wrapping and upwrapping of the cable segments as rotation of the rotary elements 100 occurs.

It will be appreciated that as the slide element 78 is drawn to the rear, a torque is exerted on the rotary elements 100 tending to rotate them against the opposing tension of the load cables 94. This causes flexing of the limbs 16 of the prod 14, by virtue of the connection of the load cables 94 to the tips thereof.

As the rotary elements 100 rotate, drawstring segments 20 lengthen in a direction extending to the rear of the cross bow 10, as additional portions of segments 20 upwrap from the grooved perimeter of the sheave members 104. As such unwrapping proceeds, it can be seen that the leverage able to be exerted by the drawstring segments 20 increases, in that the effective lever arm able to be exerted by the drawstrings 20 acting about the pivot point 102 increases, while the effective lever arm able to be exerted by the load cable 94 decreases. Thus, a pronounced variable leverage action is produced, reducing the force required to be exerted on the drawstring segments 20 in order to counteract the force exerted by the load cables 94, and the flexing of the prod limbs 16.

Again, the drawstring interconnection with the constrained slide 78 insures coordinate flexing of the prod limbs 16.

It is also noted that in order to produce a sufficient perimeter distance for adequate travel of the slide 78, the size of the rotary variable curved arm element 100 must be relatively large.

Figure 7:
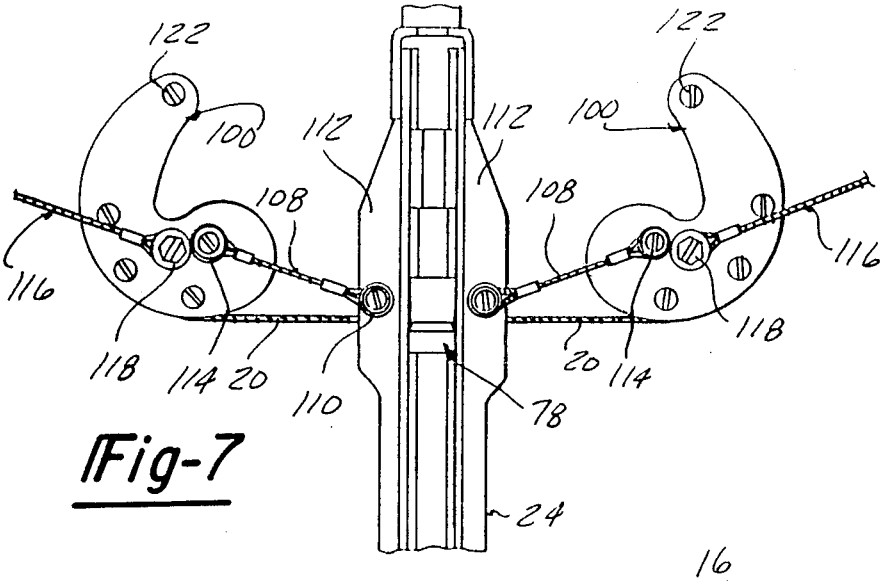
FIG. 7 is a fragmentary plan view of another embodiment of a cross bow incorporating the present invention.

It also will be noted that in both of the last described embodiments, substantially rigid clevis brackets must be provided, since tilting forces act on the rotary elements due to the offsetting of the drawstring segments and the load cables. Such rigid brackets 92, may be eliminated by another rearrangement of drawstring segments and load cables, as seen in the embodiment illustrated in FIGS. 7 through 9.

In this instance, the rotary elements 100, each constituting a variable leverage device, are mounted to the stock member 12 by means of straddling pairs of anchor cables 108, anchored at one end by means of screws 110, received in respective vertically spaced flanges 112, comprising a part of the stock frame member 24. Anchor cables 108 are secured at their other respective ends to the rotary elements 100 on posts 114, defining an axis of rotation of the rotary variable leverage elements 100.

Straddling pairs of vertically spaced load cables 116 are also provided, connected to the respective tips of limb 16 of the prod 14, and to connection points 118 on either side of the rotary elements 100. The use of straddling pairs of load cables 116 and anchor cables 108 insures that significant tipping forces will not be imposed on the rotary elements 100, such as to eliminate the need for rigid bracket mounting of the rotary element 100.

The drawstring segments 20 pass about the periphery of sheave members 120 of the rotary elements 100, as seen in FIG. 8, and anchored around screws 122, located at the tail end of rotary elements 100.

In the above described embodiment, as the drawstring segments 20 are moved to the rear by drawing movement of the slide element 78, tension is generated to exert a rotary torque on the rotary elements 100, tending to pivot them about pivot points defined by pivot connections 114, as seen in FIG. 9.

The rotation of elements 100 in turn acts on the load cables 116 to flex the tips of the limb 16 of the prod 14.

Increasing leverage is able to be exerted by the drawstring segments 20 with increasing rotation of the rotary element 100 due to the eccentric perimeter configuration thereof, as seen in FIG. 9, such that the drawing force is reduced as the drawstring segments 20 are moved to the full drawn position.

In the embodiments in FIGS. 4 through 9, the drawing motion of the drawstring segments 20, and flexing motion of the prod limbs 16, are not directly related in the sense that there is a direct correspondence of movement therebetween, since the drawstring segments 20 are not attached to the tips of the prod limbs 16. Stated another way, the necessary drawstring 18 slack to accommodate rearward slide movement is generated by unwinding from the rotary elements 100 rather than flexing of the limbs 16. Thus, as noted above, the size of the rotary elements 100 must be relatively great in order to accommodate sufficient travel of the slider element 78 and drawing movement of the drawstring 18 to allow sufficient travel of the drawstring 18 in contact with the bolt, to provide adequate transfer of potential energy into kinetic energy of the bolt, as will be appreciated by those skilled in the art.

Figure 11:
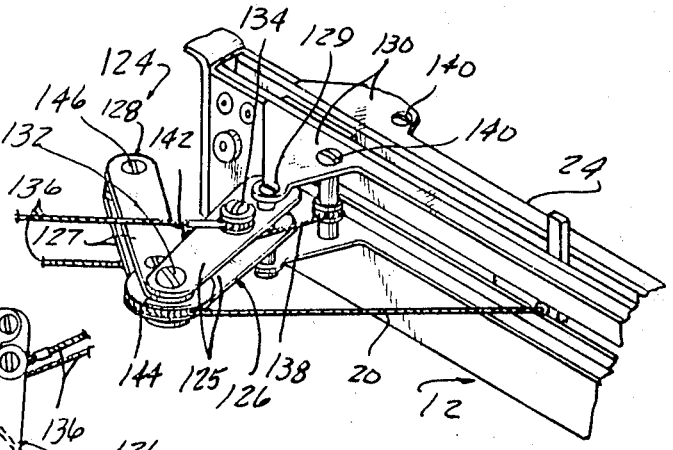
FIG. 11 is a fragmentary perspective view of portions of the cross bow shown in FIG. 10.
Figure 12:
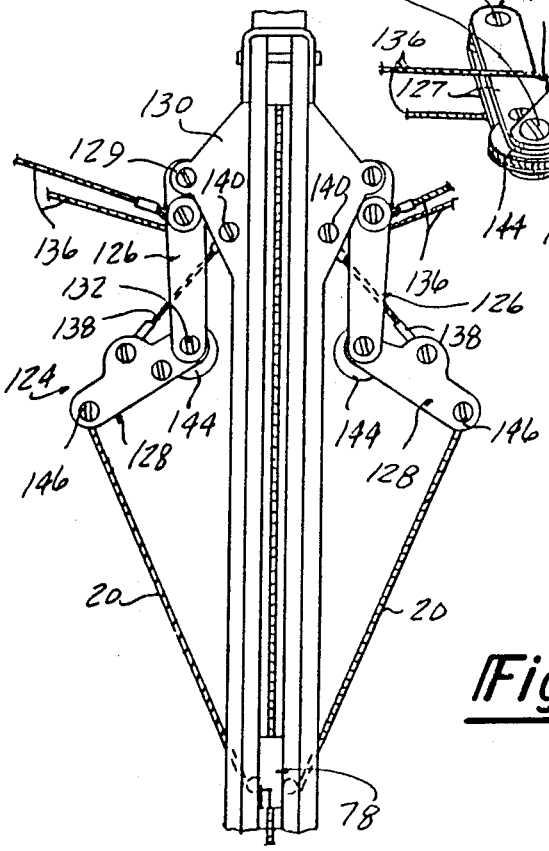
FIG. 12 is a fragmentary plan view of the cross bow shown in FIGS. 10 and 11, illustrating the variable leverage devices with the drawstring in the drawn position.

The embodiment according to FIGS. 10 through 12, provides an arrangement for allowing generation of adequate slack in the drawstring segments without the need for large diameter rotary curved arm elements.

In this embodiment, the variable leverage devices 124 are comprised of a pair of pivotally connected lever arms 126 and 128, each comprised of spaced plates 125 and 127 respectively. The inner, first lever arm 126 is pivoted at 129 to a flange 130 conforming a part of the stock member frame 24. The inner lever arm 126 is pinned at 132 at its other end to the second, outer lever arm 128.

Connected to the inner first lever arm 126 at a point 134 intermediate the length thereof, is one end of a pair of load cables 136, cables 136 connected at their other ends to the tip of the respective prod limbs 16.

The second, outer lever arm 128 is mounted intermediate the spaced plates 125 of the inner lever arm 126, each constituted by plates 123 connected by screws 146. Passing through the intermediate space between plates 125 is a reaction cable 138 anchored at 140 to the flange 130 at one end, and at the other end to the second outer lever arm 128 at 142.

Pulley guides 144 are pivotally mounted to rotary devices 124 by pivot connection 132 located at the point around which each drawstring segment 20 passes in the undrawn position, and extends to the free end of second level arm 128, to a point of connection defined by screw 146.

As the drawstring segments 20 are placed under tension upon drawing of the slide element 78, a torque is generated acting on inner lever arm 126 and outer lever arm 128 tending to rotate the same about their respective pivot points.

The rotation of lever arm 128 about its respective pivot 132 is restrained by reaction cable 138, such that rotation of the inner lever arm 126 primarily occurs as the drawstring segments 20 are moved to the rear. The rotation of the inner lever arm 126 about pivot axis 129 produces limb tip flexing via the action of attached load cables 136.

As rotation of the inner lever arms 126 proceeds, the leverage able to be exerted by the drawstring segments 20 to produce rotation of the inner lever arm 126 increases, to thereby produce the variable leverage effect.

It can be appreciated that an unfolding action is created by the rotation of the inner lever arm 126 and outer lever arm 128, generating substantial drawstring slack. It is for this reason that a very short stiff prod 14 may be employed with this design, since only a slight flexing motion of the prod limb 16 will generate a disproportionate travel of the slide element 78, such as to provide adequate draw length for good performance characteristics.

Figure 13:
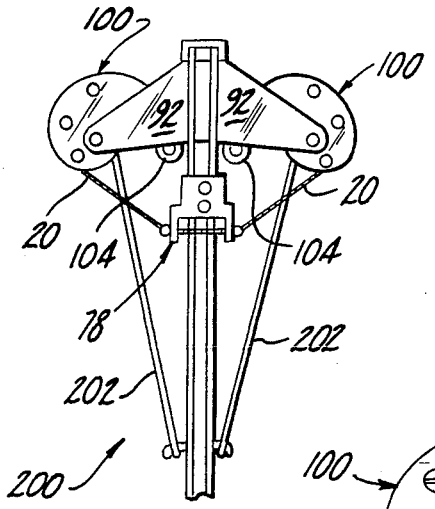
FIG. 13 is a fragmentary plan view of a mechanical projector according to the present invention incorporating elastic elements as the deflectable members generating stored energy.
Figure 14:
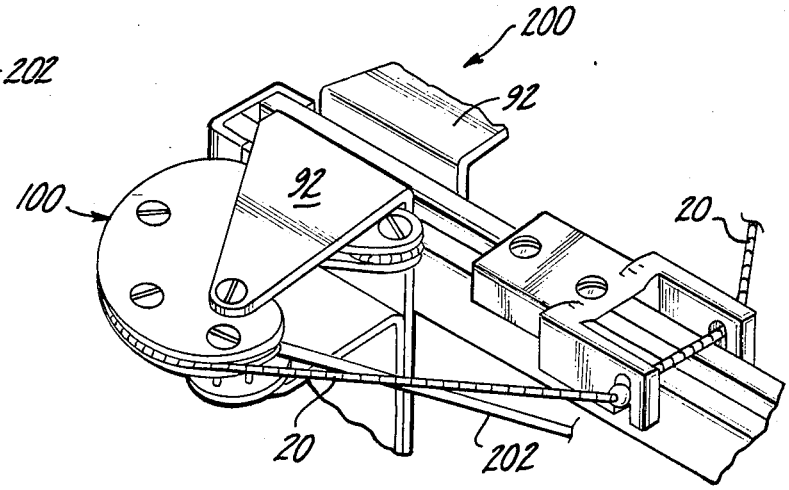
FIG. 14 is an enlarged perspective view of portions of the mechanical projector shown in FIG. 13.
Figure 15:
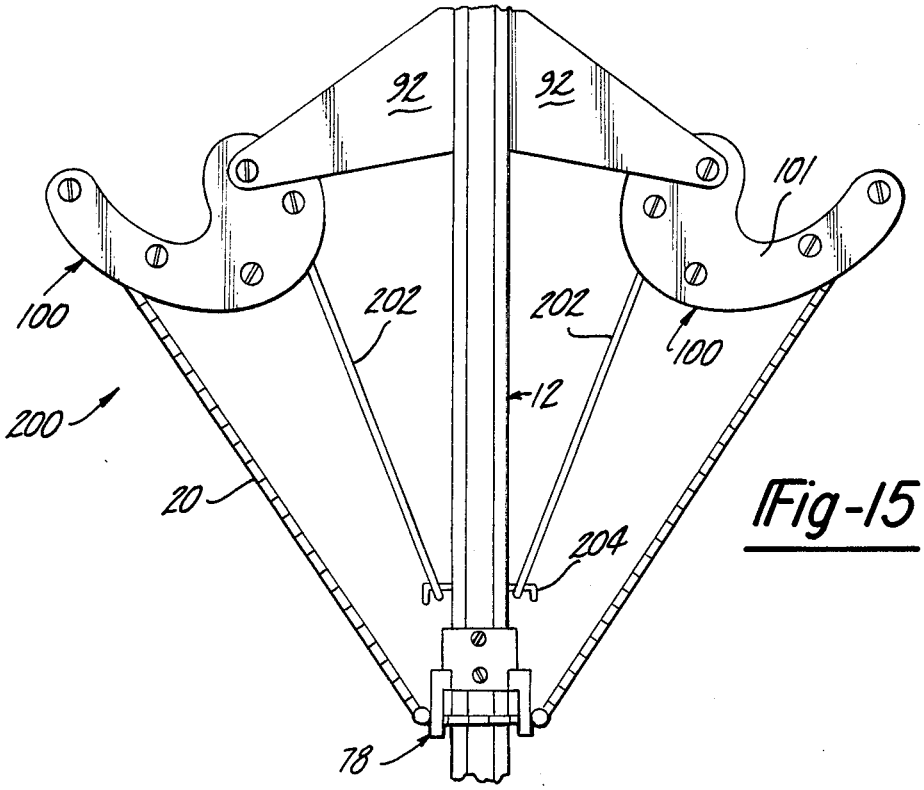
FIG. 15 is a fragmentary enlarged plan view of the mechanical projector shown in FIG. 13, with the variable leverage devices rotated by drawing of the drawstring.

A mechanical projector other than a crossbow can also incorporate the present invention, as the device shown in FIGS. 13–15. The mechanical projector 200 shown is patterned on the crossbow 10 shown in FIGS. 4–6, but utilizing a pair of elastic elements 202 which are wrapped around the rotary elements 100 and anchored at 204 to the stock member 12. Thus the means for generating the stored energy in this instance comprises the pair of elastic elements 200, which are stretched by the drawing motion of the drawstring 20 rotating rotary elements 100.

Again the drawstring 20 is fixed to the slider 78 so as to create the driving interconnection of the rotary elements 100 and the slider 78, to synchronize the rotation of each rotary element 100 with each other.

It is noted that many variations of the above described embodiments are possible within the scope of the following claims. For example, while the driving interconnection between the constrained slide and rotary elements of the variable leverage devices comprises a securement of the drawstring to the slide, it is also possible to connect the load cables to a slide to obtain the synchronization of the rotary elements.

Figure 16:
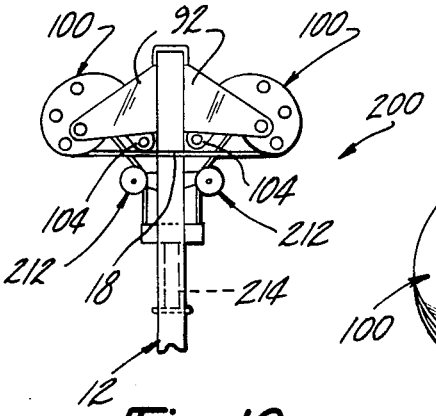
FIG. 16 is a fragmentary plan view of a mechanical projector according to the present invention incorporating a load cable connection to the slide and using a single elastic element.
Figure 17:
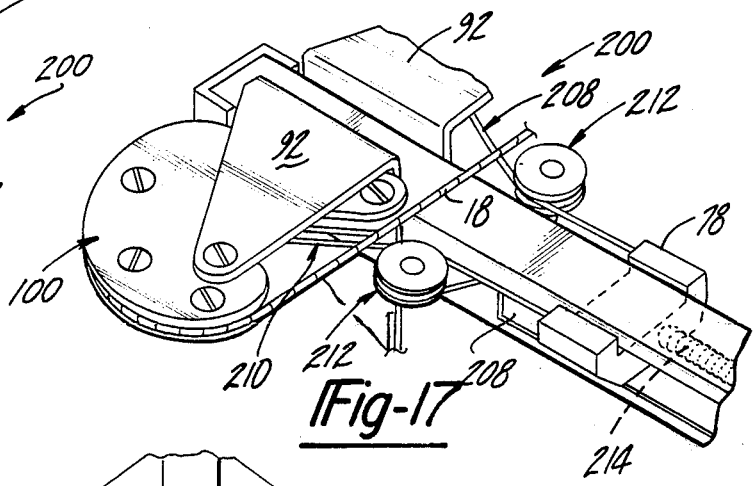
FIG. 17 is an enlarged perspective view of portions of the mechanical projector shown in FIG. 13.
Figure 18:
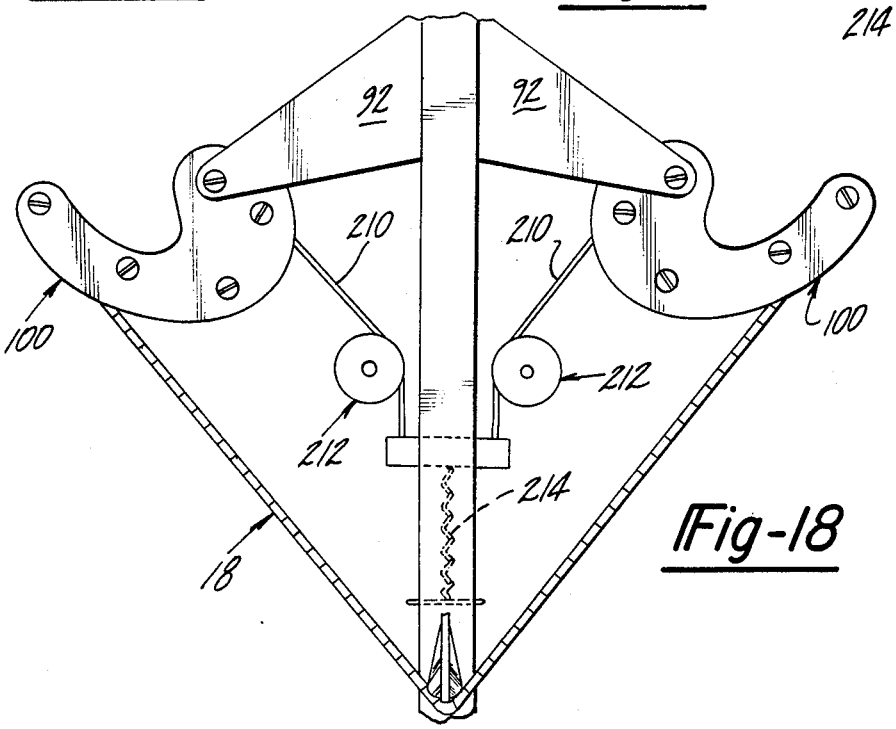
FIG. 18 is a fragmentary enlarged plan view of the mechanical projector shown in FIG. 13, with the variable leverage devices rotated by drawing of the drawstring.

This is shown in the mechanical projector 206, FIGS. 16–18, which is a modification of the cross bow shown in FIGS. 13–15. In this case the drawstring 18 extends across the stock 12 connected at either end to the rotary elements 100.

The slide 78 is mounted in a slot 208 in the stock 12 lying below the level of the drawstring 18. A pair of load cables 210 are each connected at one end to the rotary elements 100, pass around pulleys 212, and are connected at the other end to the slide 78.

The slide 78 in turn is connected to a single resilient element.

The interconnection between the slide 78 and the rotary elements 100 is thus provided by the connection of the load cables 210 to the slide 78 rather than the drawstring 18.

The rotary elements 100 are thus also synchronized in their rotation similarly to the other embodiments.

Figure 19:
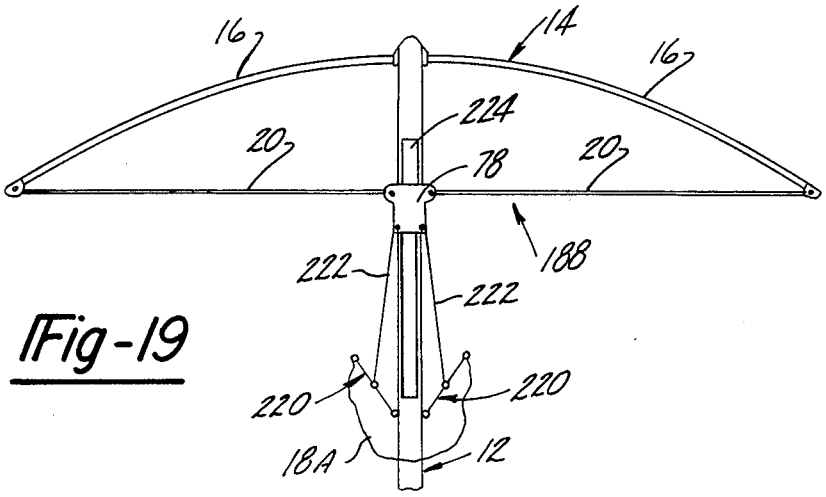
FIG. 19 is a plan view of a cross bow comprising another variation of the mechanical projector according to the present invention.

FIG. 19 shows yet another synchronizing arrangement. In this case, a primary drawstring 18A is provided connected to rotary elements comprised of bell cranks 220 pivoted to the stock 12. Load cables 222 are connected at one end to the rotary elements 220 and at the other to a slide 78 mounted on a track 224 on the stock 12.

A secondary drawstring 18B has segments 20 connected to the tips of limbs 16 of a prod 14. This also produces the synchronized rotation of bell cranks 220.

I claim:

1. A mechanical projector for launching projectiles, comprising:

an elongated stock member;

an elongated prod mounted extending across one end of said stock member, said prod having a resilient deflectable limb disposed on either side of said stock member;

a drawstring extending across said stock member and adapted to be drawn rearwardly on said stock member, said drawstring constituted by a pair of drawstring segments each mounted to extend away from either side of said stock member from a central point whereat said segments are connected to each other, said central point engageable with a projectile to be launched on said stock member;

a pair of variable leverage devices mounted on either side of said stock member; each variable leverage device including a rotary element rotatably mounted to one side of said stock member and connected to a respective drawstring segment to be rotated as said drawstring is drawn;

means generating stored energy by resilient deflection of said prod limbs upon rotation of said rotary elements of each of said variable leverage devices by drawing of said drawstring;

said means including a pair of load cables separate from said drawstring, each connecting a respective prod limb tip and wound on a rotary element of a respective variable leverage device;

each of said variable leverage devices including means varying the leverage exerted by said respective drawstring segment on a respective load cable as said drawstring is drawn to reduce the effort required to cause deflection of said prod limbs as said drawstring is fully drawn;

a slide mounted for sliding movement along the length of said elongated stock member; and, synchronizing means drivingly connecting said slide and said rotary element of each of said variable leverage devices constraining a said rotary elements to rotate in synchronism with each other, comprising said drawstring segments each fixed to said slide so as to prevent lateral movement of said drawstring relative said stock member to thereby constrain rotation of said rotary elements, each of said drawstring segments extending directly from a respective rotary element to said slide.

2. The projector according to claim 1 wherein each of said rotary elements comprise an arm having a curved perimeter and mounted for rotation about an axis extending transversely to a plane formed by said stock member and wherein said respective drawstring segment is connected to be wrapped around said arm perimeter by rotation thereof.

3. The projector according to claim 2 wherein said arm perimeter defines a varying radius about said axis of rotation to produce said varying leverage.

4. The projector according to claim 1 wherein said load cables are connected to a respective arm at a point thereon to produce unequal leverage about said axis of rotation with said respective drawstring segment, and to act oppositely therefrom to produce an opposing torque.

5. The projector according to claim 1 wherein each of said rotary variable leverage devices comprises lever arm pairs, each including a first lever arm pivotally mounted on one end to said stock member, and at least one load cable connected at an intermediate point on each of said first respective lever arm and to a respective prod limb tip and further comprises a second lever arm pivotally mounted at one end to the other end of said first lever arm, each of said drawstring segments connected to the other end of said second lever arm, a pair of tension members, each extending between said stock member and an intermediate point on a respective one of said second lever arms;

each of said first lever arms extending away from said stock member and each of said second lever arms extending inwardly and forwardly towards said stock member and prod, with said drawstring undrawn, each of said drawstring segments passing around said connected ends of the respective first and second lever arms, to the free end of said second lever arm whereby said second lever arm is caused to rotate outwardly as said drawstring is drawn and said prod tips are flexed as said first lever arm is rotated by the force exerted by said tension of said connected load cable induced by rotation of said first lever arm acting through said second lever arm.

6. The projector according to claim 1 wherein said at least one resiliently deflectable member comprises a pair of elastic elements, each connected to a respective rotary element to be stretched by rotation thereof by drawing of said drawstring.

7. The projector according to claim 1 in which said load cables are attached to said at least one deflectable resilient member so that the shortening of said cables upon the rotation of said variable leverage devices increases the deflection of said at least one resiliently deflectable member, with an increase in the stress applied to said member.

8. The projector according to claim 7 wherein said load cables are connected to said slide to comprise said synchronizing means interconnecting said slide and said rotary elements.

9. The projector according to claim 8 wherein a single resilient element comprises said at least one deflectable member, said element connected to said slide to be stretched by movement thereof.

* * * * *